US007019725B1

(12) United States Patent
Lee et al.

(10) Patent No.: US 7,019,725 B1
(45) Date of Patent: Mar. 28, 2006

(54) RESET METHOD AND APPARATUS FOR LIQUID CRYSTAL DISPLAY

(75) Inventors: Hyun Chang Lee, Seoul (KR); Yong Hoon Choi, Koonpo-shi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 914 days.

(21) Appl. No.: 09/667,718

(22) Filed: Sep. 22, 2000

(30) Foreign Application Priority Data

Sep. 22, 1999 (KR) ..... 1999-40984

(51) Int. Cl.
*G09G 3/36* (2006.01)

(52) U.S. Cl. ..... 345/98; 345/99; 345/58

(58) Field of Classification Search ..... 345/55, 345/58, 87, 95, 100, 98, 94, 99
See application file for complete search history.

(56) References Cited

U.S. PATENT DOCUMENTS 4,319,237 A * 3/1982 Matsuo et al. ..... 345/101
4,393,379 A * 7/1983 Berting et al. ..... 345/100
5,594,464 A * 1/1997 Tanaka et al. ..... 345/94
5,835,075 A * 11/1998 Nomura et al. ..... 345/97
5,841,410 A * 11/1998 Oda et al. ..... 345/58
5,852,425 A * 12/1998 Bird et al. ..... 345/92
5,900,852 A * 5/1999 Tanaka et al. ..... 345/87
6,151,016 A * 11/2000 Kanbe et al. ..... 345/204
6,222,516 B1 * 4/2001 Oda et al. ..... 345/94
6,236,385 B1 * 5/2001 Nomura et al. ..... 345/95
6,310,616 B1 * 10/2001 Yanagi et al. ..... 345/211
6,396,468 B1 * 5/2002 Matsushima et al. ..... 345/87
6,414,669 B1 * 7/2002 Masazumi ..... 345/98
6,590,553 B1 * 7/2003 Kimura et al. ..... 345/92

* cited by examiner

*Primary Examiner*—Guy Lamarre
*Assistant Examiner*—Fritz Alphonse
(74) *Attorney, Agent, or Firm*—McKenna Long & Aldridge LLP

(57) ABSTRACT

A reset method and apparatus for a color liquid crystal display device that is capable of reducing a reset interval of a panel to increase a lighting time of a back light. In the method and apparatus, a reset voltage is simultaneously applied to all liquid crystal cells of the liquid crystal display device to reset the liquid crystal display device. Accordingly, all the liquid crystal cells are simultaneously reset by utilizing a common voltage or a gate voltage, so that the reset interval can not only be dramatically shortened to reduce flicker, but also color interference among red, green and blue colors can be eliminated to prevent color blur.

11 Claims, 6 Drawing Sheets

RESET METHOD AND APPARATUS FOR LIQUID CRYSTAL DISPLAY

This application claims the benefit of Korean Patent Application No. 1999-40984, filed on Sep. 22, 1999, which is hereby incorporated by reference for all purposes as if fully set forth herein.

BACKGROUND OF THE INVENTION

1. Field of the Invention

The present invention relates to a liquid crystal display device, and more particularly to a liquid crystal display device that is capable of reducing a reset interval of a panel to increment a lighting time of a back light.

2. Discussion of the Related Art

Generally, an active matrix liquid crystal display (LCD) controls the light transmissivity of liquid crystal cells using an electric field to display a picture. To this end, the active matrix LCD includes a liquid crystal panel having liquid crystal cells arranged in a matrix type, and a driving circuit for driving the liquid crystal panel. The liquid crystal panel is provided with pixel electrodes for applying an electric field to each liquid crystal cell and a reference electrode (i.e., common electrode). A pixel electrode is formed at a lower substrate for each liquid crystal cell, while the common electrode is integrally formed at the entire surface of an upper substrate. Each pixel electrode is connected, via source and drain terminals of a thin film transistor using as a switching device, to a one of a plurality of data lines. Each gate terminal of the thin film transistors is connected to a one of a plurality of gate lines allowing a pixel voltage signal to be applied to pixel electrodes for one line.

Such an LCD makes use of red (R), green (G) and blue (B) color filters or color back lights to control a mixed ratio of the three original colors properly, thereby realizing a desired color. More specifically, an LCD using the color filters employs red, green and blue color filters for each pixel, including three liquid crystal cells, to realize a color by red, green and blue data applied simultaneously. An LCD using the color backlights turns on red, green and blue backlights sequentially in compliance with color data to be displayed. A color realization method for an LCD using such color backlights has been disclosed in Korean Patent Application No. P95-2771, filed on Feb. 15, 1995.

As shown in FIG. 1, the color LCD disclosed in the above Korean Patent Application charges any one of red, green and blue color data into liquid crystal cells in one vertical synchronizing interval (1 Vsync), and turns on the corresponding color back light at a middle time point of a color data charge time $T_r$, thereby expressing a color. To assure a sufficient lamp turn-on time to improve the brightness, the back light should be turned on before a charge of any one-color data into all of the liquid crystal cells in the liquid crystal panel has been completed. However, if the back light lamp is turned on before a charge of any one-color data into all the liquid crystal cells has been completed, then color purity is deteriorated, producing a color-blurring phenomenon.

For instance, in the case of charging green (G) data in the liquid crystal cells line-sequentially from the first line assuming that color data should be displayed in a sequence of red (R), green (G) and blue (B) colors as shown in FIG. 1, green (G) data has been charged in the upper liquid crystal cells at a time when the green (G) back light is turned on; while red (R) data from the previous frame has been charged in the lower liquid crystal cells in which green (G) data has not yet been charged. If the green back light is turned on in this state, then the upper liquid crystal cells charged with green (G) data expresses a normal color, whereas the lower liquid crystal cells still holding red (R) data from the previous frame results in a transmission of a green light to generate a color blur.

In order to prevent such a color-blurring phenomenon, all the liquid crystal cells are reset after displaying any one-color data and before displaying the next color data. More specifically, red (R) data voltage having been held in the liquid crystal cells is discharged after displaying red (R) data and before displaying green (G) data to reset all of the pixels before charging green (G) data. Since the backlight has been turned off during the majority of such a reset interval, as a reset interval becomes longer, a quantity of light transmitted through the panel becomes smaller. Thus, the total brightness is reduced.

However, the conventional reset method of the liquid crystal panel requires a relatively large time of 3.1 ms because a reset voltage is applied to the data line while scanning the gate line sequentially in similarity to charging the pixel data to thereby reset the liquid crystal cells. Accordingly, the backlight has been turned off during a charging time (i.e., 3.1 ms) of data plus a reset time (i.e., 5 ms), that is, during the maximum 8.1 ms in one vertical period of 16.67 ms, so that the brightness is reduced. Also, in the conventional reset method, power consumption is increased because the gate line is sequentially scanned twice (i.e., once for charge and once for reset) during one vertical period. In addition, since the liquid crystal cells in the panel are discharged to a voltage allowing no transmission of light in the reset interval, as the reset interval becomes longer, a time interval when the panel takes on a black color is lengthened to generate a flicker phenomenon that alternates a bright state and a dark state of a screen. As a result, since it becomes difficult to express a natural picture on the screen due to a relatively long reset interval, the conventional reset method fails to express a clear picture.

Recently, there has been suggested a scheme of allowing the red, green, and blue data to be sequentially displayed for one frame by increasing a charging speed of color data into the liquid crystal cells, because it is difficult to express a natural picture when any one color data is displayed in one frame. In this scheme, since a turn-on time of the back light is relatively shortened, it can avoid deepening the above-mentioned problems involved in the reset interval.

SUMMARY OF THE INVENTION

Accordingly, the present invention is directed to a reset method and apparatus for liquid crystal display that substantially obviates one or more of the problems due to limitations and disadvantages of the related art.

An object of the present invention is to provide a reset method and apparatus of a liquid crystal display device that is capable of shortening a reset time to increment a lighting time of a back light, thereby reducing flicker and color blur.

A further object of the present invention is to provide a reset method and apparatus that is capable of reducing power required for a reset interval.

Additional features and advantages of the invention will be set forth in the description which follows, and in part will be apparent from the description, or may be learned by practice of the invention. The objectives and other advantages of the invention will be realized and attained by the structures particularly pointed out in the written description and claims hereof as well as the appended drawings.

In order to achieve these and other objects of the invention, a method of resetting a liquid crystal display device according to one aspect includes applying a reset voltage to all liquid crystal cells of the liquid crystal display device to reset the liquid crystal display device.

A reset circuit for a liquid crystal display device according to another aspect includes voltage selecting means for selecting, in response to an input control signal, a normal common voltage to be applied to a common electrode of the liquid crystal display device in an interval when a data voltage is charged and maintained in all liquid crystal cells of the liquid crystal display, and for selecting, in response to the input control signal, a reset voltage having a value less than the normal common voltage to be applied to the common electrode in a reset interval.

A reset circuit for a liquid crystal display device according to still another aspect includes a voltage amplifier for amplifying an input control signal having a specific logical state only in a reset interval when liquid crystal cells of the liquid crystal display device are reset, the amplified input control signal to be applied to a common electrode of the liquid crystal display device.

A reset circuit for a liquid crystal display device according to still another aspect includes a shift register for generating sequential gate driving signals; logical OR gates for performing a logical OR operation of an input reset signal and each gate driving signal from the shift register; and level shifters connected individually to outputs of the logical OR gates to select and output a gate voltage in accordance with a logical state of a signal outputted from each of the logical OR gates.

It is to be understood that both the foregoing general description and the following detailed description are exemplary and explanatory and are intended to provide further explanation of the invention as claimed.

BRIEF DESCRIPTION OF THE DRAWING

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiment of the present invention, example of which is illustrated in the accompanying drawings.

Figure 1:
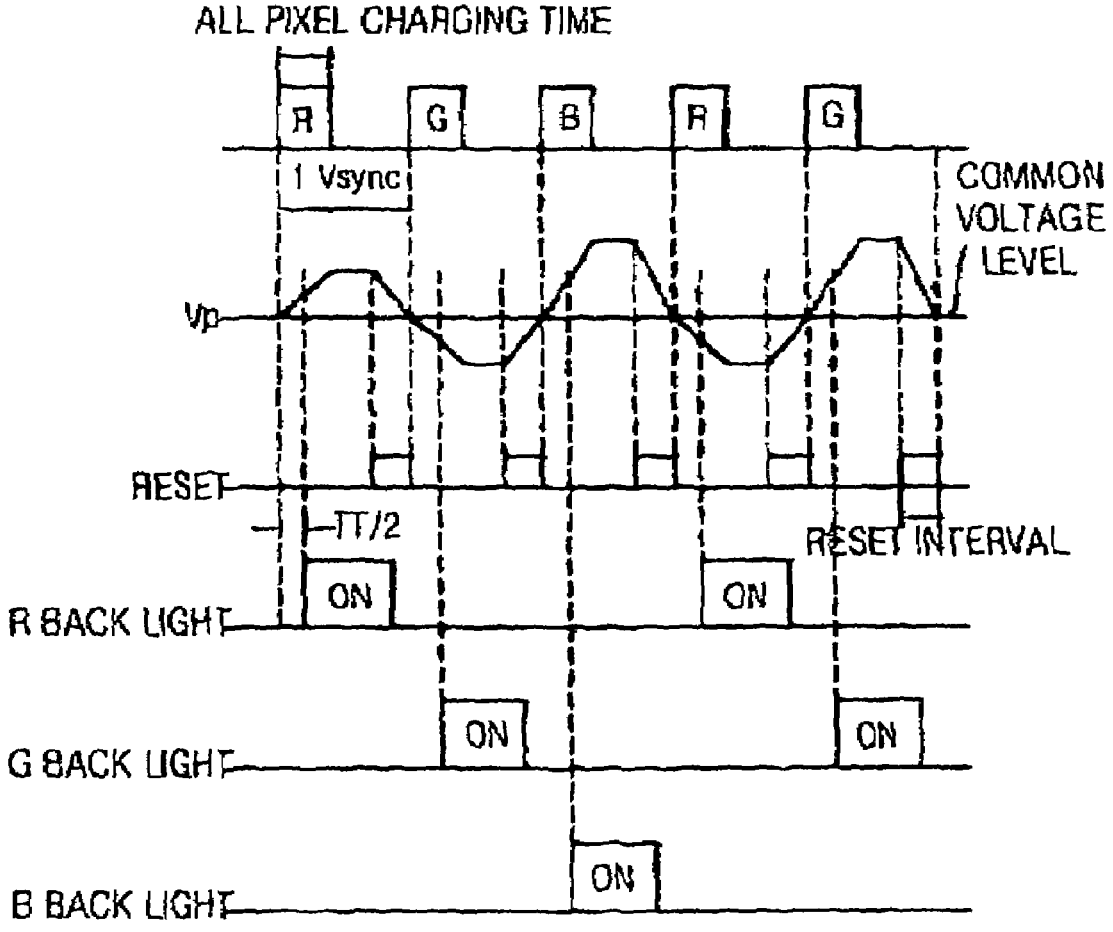
FIG. 1 PRIOR ART
FIG. 1 is a timing chart for explaining a color realization method in a conventional liquid crystal display device using a color back light.
Figure 2:
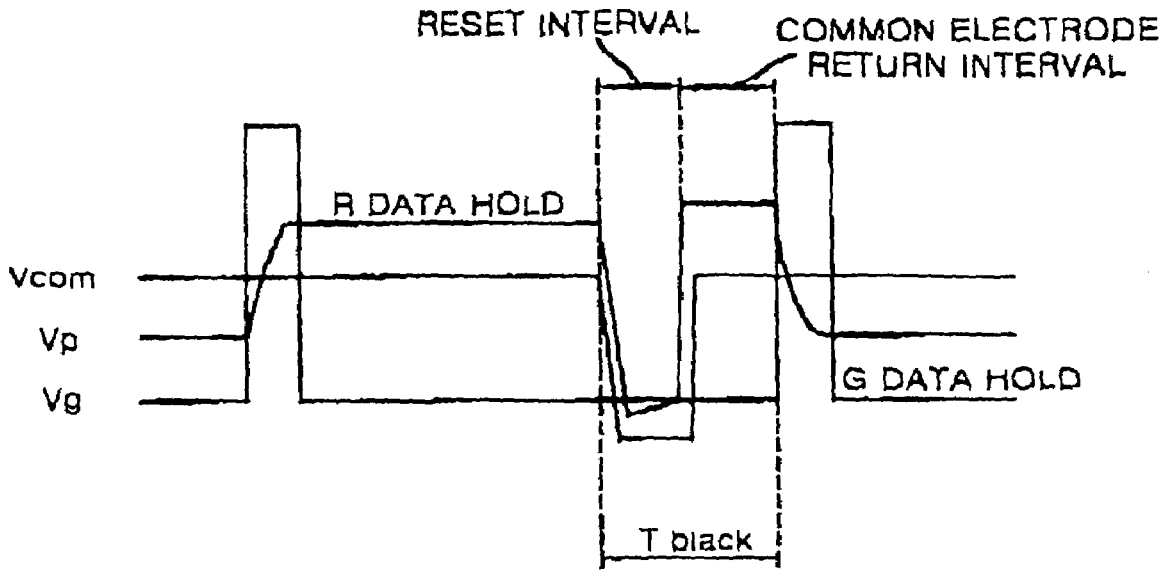
FIG. 2 is a voltage waveform diagram for explaining a reset method for a liquid crystal display device according to a first embodiment.

FIG. 2 is a voltage waveform diagram for explaining a reset method of a liquid crystal display device according to a first embodiment, which represents a relationship among a gate voltage Vg, a pixel voltage Vp, and a common electrode voltage Vcom applied to one liquid crystal cell. In FIG. 2, the common electrode voltage is utilized for a method of resetting a pixel. More specifically, after red (R) data is charged and held, the common electrode voltage Vcom is lowered to a voltage (i.e., reset Vcom) lower than a gate-off voltage (i.e., a gate low voltage Vgl) by a saturation voltage of the liquid crystal at a predetermined time prior to a time when the next green (G) data begins being charged. The predetermined time varies with the dimension of the panel and, for example, is preferably about 100 μs in the case of a 13.3" panel. In this case, since a gate low voltage Vgl is applied to a gate line GL to turn off a thin film transistor (TFT) in an equivalent circuit of a liquid crystal cell shown in FIG. 3, a pixel voltage Vp drops to such an extent that a common electrode voltage Vcom as a reference voltage drops (i.e., the pixel voltage Vp follows the common electrode voltage Vcom). Subsequently, when the common electrode voltage Vcom arrives at a reset voltage (reset Vcom), a channel is defined in the TFT to converge the pixel voltage Vp to the gate low voltage Vgl. The channel formation in the TFT is caused by the fact that the pixel voltage Vp —which has been dropped by the drop amount of the common electrode voltage Vcom—has a voltage lower than the gate low voltage Vgl. In this case, a voltage at the data line DL affects the time when the pixel voltage Vp is converged to the gate low voltage Vgl. In order to converge the pixel voltage Vp to the gate low voltage Vgl rapidly, the voltage at the data line DL must be set to be larger than a reference voltage (i.e., ground voltage) if possible. As a result, if the pixel voltage Vp drops to a reset voltage (reset Vcom) of the common electrode voltage Vcom within the reset interval, then it is converged to the gate low voltage Vgl. Furthermore, if the common electrode voltage Vcom rises to an original voltage level after a reset interval, then the pixel voltage Vp also rises to the same extent as the common electrode voltage Vcom rises, because of a capacitor coupling effect maintaining the potential difference derived between the pixel voltage Vp and the common electrode voltage Vcom. This is caused by the fact that, since the gate voltage Vg of the TFT has a lower level than the voltage at the data line DL and a lower level than the pixel voltage Vp, a channel is not formed in the TFT.

For example, assuming that a usual gate low voltage Vgl is −5V, a voltage Vp charged in a liquid crystal cell is 8V and a common electrode voltage Vcom is 5V, when a voltage at the data line DL is set to 5V and the common electrode voltage Vcom drops to −10 V in a reset interval, the pixel voltage Vp also drops to −7V. At this time, since the pixel voltage Vp is 2V lower than the gate low voltage Vgl, the TFT is turned on. Accordingly, as the pixel voltage Vp rises to be converged to the gate low voltage Vgl, a channel having been formed in the TFT begins to disappear gradually and disappears completely at an instant when the pixel voltage Vp becomes equal to the gate low voltage Vgl, thereby allowing the TFT to be turned off. As a result, in the reset interval, the pixel voltage Vp is converged to the gate low voltage Vgl of −5V and a voltage of 5V is derived between the pixel voltage Vp and the common electrode voltage Vcom. Since the common electrode voltage Vcom must be returned to an original voltage after the lapse of such a reset interval and prior to charging of the next color data, it rises to 5V again. At this time, the TFT is turned off. This is caused by the fact that, since the pixel voltage Vp rises while the gate voltage Vg is maintained as it is, a channel is not formed in the TFT. Accordingly, charging and discharging through the channel of the TFT does not occur, so that a potential difference derived between the pixel electrode and the common electrode is maintained as it is in the reset interval. In other words, when the common electrode voltage Vcom is 5V, the pixel voltage Vp becomes 10V. As described above, a voltage between the pixel voltage Vp and the common electrode voltage Vcom remains at 5V in the reset interval and in the common electrode return time, so that a black color is always displayed in the normally white mode liquid crystal.

The foregoing has been calculated assuming that a threshold voltage Vth of the TFT is "0". Since the threshold voltage Vth of the TFT is not "0", however, the common electrode voltage Vcom for resetting the liquid crystal cell must have a value equal to:

$$Vcom = Vgl - \text{liquid crystal saturation voltage} - Vth \quad (1)$$

This is because the gate voltage Vg is higher than a voltage at the source terminal or the drain terminal by the threshold voltage, Vth, when a channel is formed in the TFT.

Herein, a current value generated in the channel of the TFT indicated by a relationship between a voltage at each terminal of the TFT and component parameters is as follows:

$$\text{<MARGIN><}TR\text{><}P\text{>}I_D = \mu CWIL[(Vg - Vth)/V_D - \tfrac{1}{2} \times V_D^2]\text{<}IP\text{>} \quad (2)$$

wherein $I_D$ represents a current passing through the channel of the TFT, μ denotes an electron mobility, W denotes a width of the channel, L denotes a length of the channel, Vg denotes a gate voltage, and $V_D$ represents a source or drain voltage. Since a gate high voltage Vgh is applied to the gate line GL upon data charging of the pixel, a current $I_D$ passing through the channel of the TFT is increased as seen from the above equation (2).

Thus, it becomes possible to charge a desired data voltage to a liquid crystal cell within a time period of about 10 to 20 μs, depending upon a size of the liquid crystal panel, and resistance and capacitance of the gate line GL and the data line DL. A resistance of the channel produced at the thin film transistor in the reset interval reduces the value of a current passing through the TFT because a voltage difference between a gate voltage Vg and a source or drain voltage is small.

Figure 3:
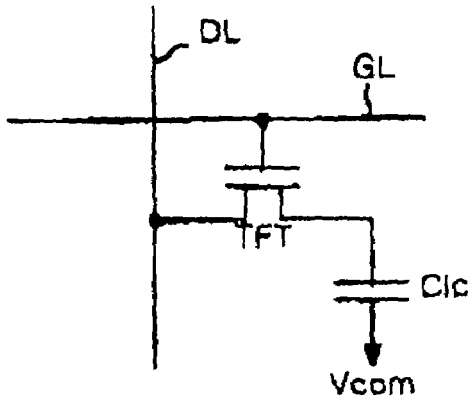
FIG. 3 is an equivalent circuit diagram of a liquid crystal cell in the liquid crystal display device.
Figure 4:
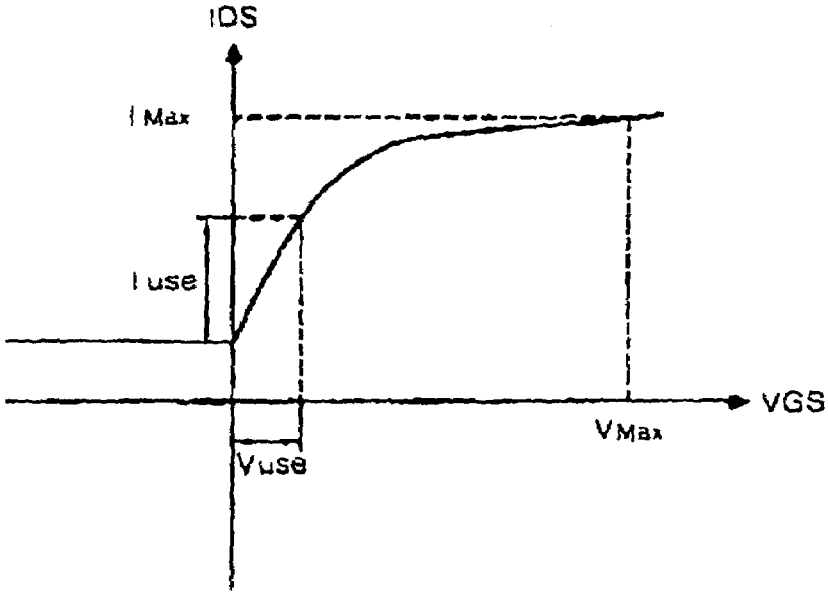
FIG. 4 is a characteristic diagram representing a voltage/current relationship between terminals when a channel is formed in the thin film transistor shown in FIG. 3 to make a flow of current.

FIG. 4 depicts a voltage relationship between each interval when a channel is formed in the TFT shown in FIG. 3 to permit a current to flow. In FIG. 4, Imax and Vmax represent a maximum current passing through a channel when data is charged in the liquid crystal cell, and a maximum voltage between the gate electrode and the data electrode or between the gate electrode and the pixel electrode, respectively; and Iuse and Vuse represent a current range and a voltage range when the channel has been formed in the TFT in the reset interval, which are relatively small. As seen from FIG. 4, since a current passing through the channel of the TFT is large in a data charging interval of the liquid crystal cell, it is possible to charge a desired data to the pixel electrode within a short time period (i.e., 10 to 20 μs) which is different depending upon parameters of the gate line GL, the data line DL or the TFT of the panel. On the other hand, since a current passing through the channel of the TFT in the reset interval is smaller than a current flowing in the data charging interval, a longer time than a data charging time is required. A time interval in which a data voltage is charged in a single line may be shorter than the reset interval because the data voltage is charged in the liquid crystal cell by applying the gate high voltage Vgh to the gate lines GL sequentially, but a time charging data for the entire panel becomes larger than the reset interval.

Figure 5:
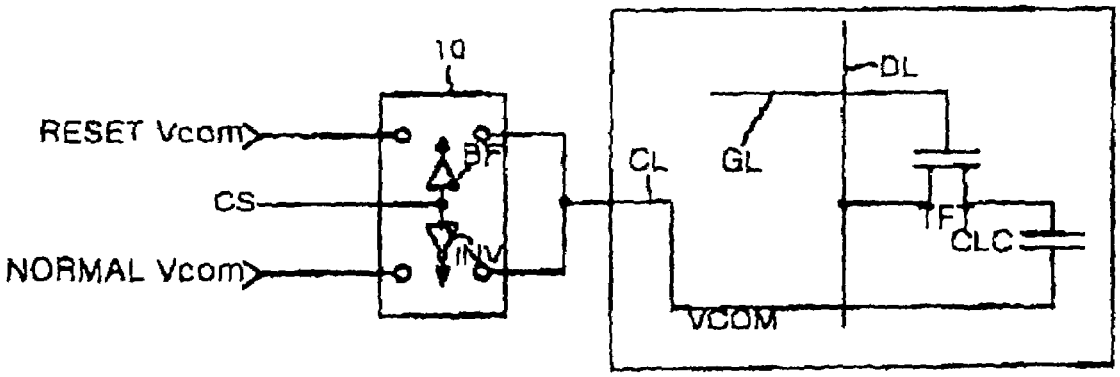
FIG. 5 is a circuit diagram of a reset circuit in a liquid crystal display device according to a first embodiment of the present invention.
Figure 6:
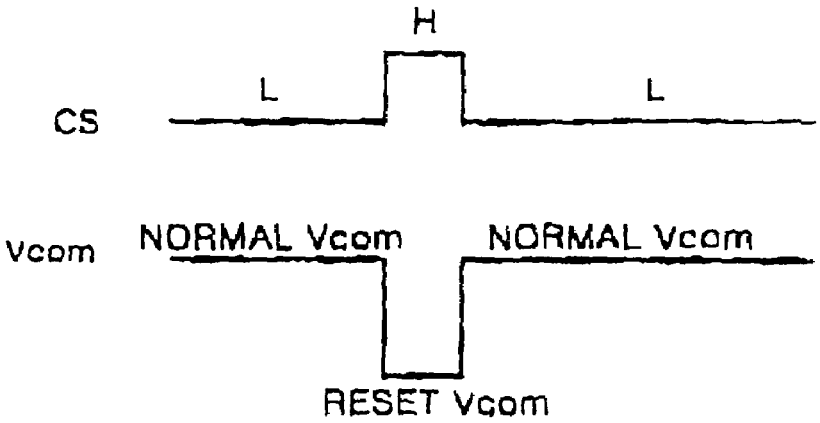
FIG. 6 is diagrams showing waveforms of a control signal and an output signal of the multiplexor shown in FIG. 5.

Referring to FIG. 5, there is shown a reset circuit in a color liquid crystal display device according to a first embodiment. The reset circuit allows a reset voltage (reset Vcom) to be applied to a common electrode in a reset interval, while allowing a normal common electrode voltage (normal Vcom) to be applied to the common electrode at other times. To this end, the reset circuit includes a multiplexor 10 for selectively switching between the reset voltage (reset Vcom) and the normal common electrode voltage (normal Vcom) in response to a control signal CS input from the exterior thereof, to apply the selectively switched voltage to a common electrode line CL. As shown in FIG. 5, the multiplexor 10 consists of a buffer BF and an inverter INV commonly connected to a control signal (CS) input line, and a switch individually connected to the buffer BF and the inverter INV. When the control signal CS is a high state H as shown in FIG. 6, the multiplexor 10 applies a reset voltage (reset Vcom) to the common electrode line CL to reset voltages at all the liquid crystal cells to a certain voltage. On the other hand, when the control signal CS is a low state L, the multiplexor 10 applies a normal common electrode voltage (normal Vcom) to the common electrode line CL, thereby charging data into the liquid crystal cell and keeping the charged data.

Figure 7:
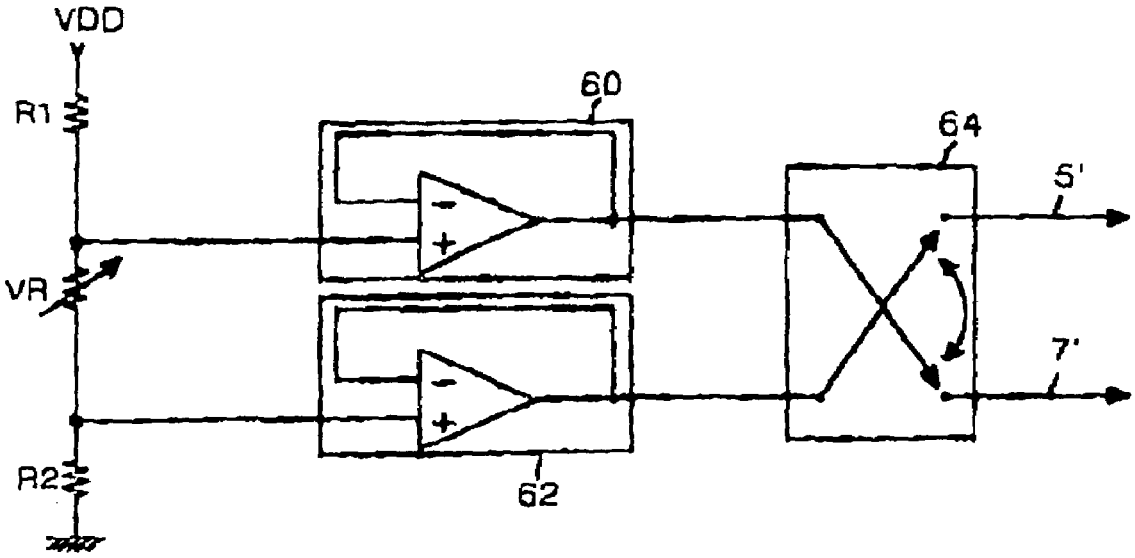
FIG. 7 is a circuit diagram of a reset circuit in a liquid crystal display device according to a second embodiment.

Referring to FIG. 7, there is shown a reset circuit in a color liquid crystal display device according to a second embodiment. The reset circuit includes a voltage amplifier 62. The voltage amplifier 62 inversely amplifies the control signal CS shown in FIG. 6 into a common electrode voltage Vcom. More specifically, the voltage amplifier 62 inversely amplifies a control signal CS inputted to a first resistor R1 at a ratio of R2/R1 to output the common electrode voltage Vcom, a direct current (DC) level of which is controlled by a variable resistor VR to output a desired common electrode voltage Vcom. In this case, the common electrode voltage Vcom is applied to the common electrode line CL.

Figure 8:
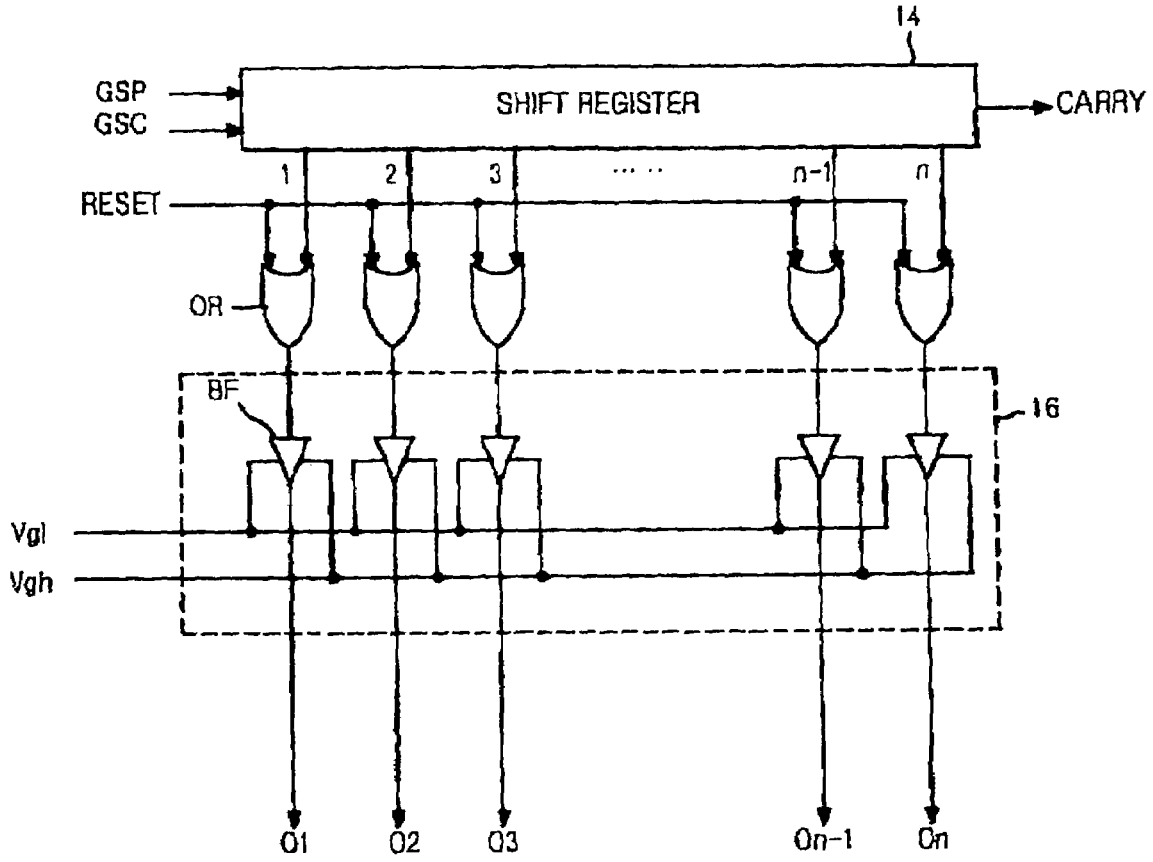
FIG. 8 is a circuit diagram of a reset circuit in a liquid crystal display device according to a third embodiment.

Referring to FIG. 8, there is shown a reset circuit in a color liquid crystal display device according to a third embodiment. The reset circuit of the third embodiment aims at resetting all the liquid crystal cells using a gate voltage. The reset circuit of the third embodiment applies a reset voltage, that is, a gate high voltage Vgh, simultaneously to the all the gate lines GL in the reset interval to reset all the pixel voltages to a certain voltage. Since the conventional gate driver includes a shift register, however, there is no choice but to drive the gate lines GL sequentially. Accordingly, the configuration shown in FIG. 8 is provided for the purpose of sequentially driving the gate lines GL in the data charging interval, but simultaneously driving the gate lines GL in the reset interval. The reset circuit of FIG. 8 includes a shift register 14 for generating sequential gate driving signals, n logical OR gates commonly connected to a reset voltage input line, and individually connected to output lines of the shift register 14, and a level shifter array 16 connected to the logical OR gates. The shift register 14 shifts a gate start pulse GSP input from the exterior thereof sequentially in accordance with a gate clock signal GSC as shown in FIG.

Figure 9:
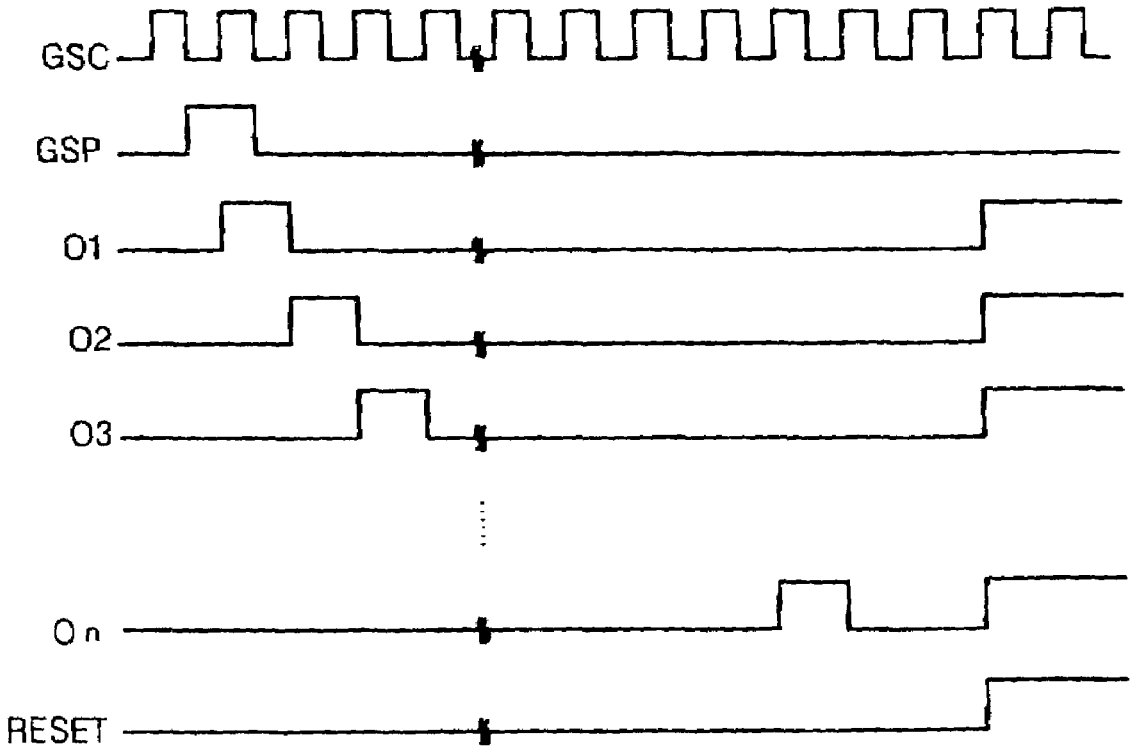
FIG. 9 is waveform diagrams of input/output signals of each component shown in FIG. 8.

9 and then outputs the same. The logical OR gates each output a high level voltage when an output signal of the shift register 14 is a high state or when a reset voltage is a high state. In other words, the logical OR gates sequentially generate high-level output signals in the data charging interval when the output signals of the shift register 14 go to a high level state sequentially. Also, the logical OR gates simultaneously generate a high-level output signal in the reset interval. Each of the level shifters included in the level shifter array 16 is connected between the logical sum gate OR and the data line DL to output a gate high voltage Vgh when an output signal of the logical OR gates is a high level signal, and output a gate low voltage Vgl when an output signal of the logical OR gates is at a low level. In other words, as shown in FIG. 9, the level shifters sequentially select a gate high voltage Vgh in the data charging interval, when the output signals of the logical OR gates go to a high level state sequentially, to generate output signals Ol to On. Also, the level shifters simultaneously select a gate high voltage Vgh during the reset interval, when the output signals of the logical OR gates go to a high level state simultaneously, to generate output signals Ol to On. Thus, the gate lines are sequentially driven in the data charging interval to charge data, whereas the gate lines are commonly driven in the reset interval to reset all the liquid crystal cells.

Meanwhile, a liquid crystal display panel including a color filter also sets a data reset interval after the data discharging interval every frame so as to prevent a phenomenon of leaving an image from the previous frame as a residual image to exhibit a slow response speed when red, green and blue data are simultaneously applied to display a picture for each frame. In this case, all the liquid crystal cells of the liquid crystal display panel can be simultaneously reset by applying the reset method according to the present invention, thereby relatively reducing a reset interval in comparison to a reset method adopting the conventional scanning system.

As described above, according to the present invention, all the liquid crystal cells are simultaneously reset by utilizing the common voltage or the gate voltage, so that the reset interval can not only be shortened to reduce flicker, but also color interference among red, green and blue colors can be eliminated to prevent color blur. In addition, a lighting time of the back light can not only be incremented to increase the brightness, but also the gate line can be scanned only once for one vertical interval to reduce power consumption.

It will be apparent to those skilled in the art that various modifications and variation can be made in the present invention without departing from the spirit or scope of the invention. Thus, it is intended that the present invention cover the modifications and variations of this invention within the scope of the appended claims and their equivalents.

What is claimed is:

1. A method of driving a liquid crystal display device having a plurality of liquid crystal cells disposed in a matrix of rows and columns, comprising:

scanning the rows of liquid crystal cells in the liquid crystal display device sequentially; and subsequently, resetting each liquid crystal cell of the liquid crystal display device simultaneously, wherein resetting each liquid crystal cell of the liquid crystal display device simultaneously comprises applying a reset voltage to a common electrode of the liquid crystal display device.

2. A method of driving a liquid crystal display device having a plurality of liquid crystal cells disposed in a matrix of rows and columns, comprising:

scanning the rows of liquid crystal cells in the liquid crystal display device sequentially; and subsequently, resetting each liquid crystal cell of the liquid crystal display device simultaneously, wherein resetting each liquid crystal cell of the liquid crystal display device simultaneously comprises simultaneously applying a gate high voltage to a gate electrode line of each liquid crystal cell.

3. A method of resetting a liquid crystal display device, comprising applying a reset voltage to all liquid crystal cells of the liquid crystal display device to reset the liquid crystal display device, wherein the reset voltage is a gate high voltage simultaneously applied to gate electrode lines of the liquid crystal display device.

4. A reset circuit for a liquid crystal display device, comprising:

voltage selecting means for selecting, in response to an input control signal, a normal common voltage to be applied to a common electrode of the liquid crystal display device in an interval when a data voltage is charged and maintained in all liquid crystal cells of the liquid crystal display, and for selecting, in response to the input control signal, a reset voltage less than the normal common voltage to be applied to the common electrode in a reset interval.

5. A reset circuit for a liquid crystal display device, comprising:

a voltage amplifier for amplifying an input control signal having a specific logical state only in a reset interval when liquid crystal cells of the liquid crystal display device are reset, the amplified input control signal to be applied to a common electrode of the liquid crystal display device.

6. The reset circuit as claimed in claim 5, wherein the voltage amplifier outputs a normal common electrode voltage in an interval when a data voltage is charged and maintained in the liquid crystal cells, and outputs a reset voltage less than the normal common electrode voltage in the reset interval.

7. A reset circuit for a liquid crystal display device, comprising:

a shift register for generating sequential gate driving signals;

logical OR gates for performing a logical OR operation of an input reset signal and each gate driving signal from the shift register; and level shifters connected individually to outputs of the logical OR gates to select and output a gate voltage in accordance with a logical state of a signal outputted from each of the logical OR gates.

8. The reset circuit as claimed in claim 7, wherein each of the level shifters applies a gate high voltage to a corresponding gate line when an output signal of the corresponding logical OR gate is in a logical high state, and applies a gate low voltage to the corresponding gate line when an output signal of the corresponding logical OR gate is in a logical low state.

9. The reset circuit as claimed in claim 7, wherein the reset circuit is included in a gate driving integrated circuit.

10. A liquid crystal display device, comprising:

a plurality of liquid crystal cells arranged in a matrix of rows and columns;

means for sequentially scanning the rows of liquid crystal cells;

means for simultaneously resetting all of the liquid crystal cells; and a common electrode, wherein the means for simultaneously resetting all of the liquid crystal cells comprises means for applying a reset voltage level to the common electrode.

11. A liquid crystal display device, comprising:

a plurality of liquid crystal cells arranged in a matrix of rows and columns;

means for sequentially scanning the rows of liquid crystal cells;

means for simultaneously resetting all of the liquid crystal cells; and further comprising a plurality of gate lines, each gate line being connected to a corresponding row of liquid crystal cells, wherein the means for simultaneously resetting all of the liquid crystal cells comprises means for simultaneously applying a gate high voltage to each gate line.

* * * * *